US006427679B1

(12) United States Patent
Chen

(10) Patent No.: US 6,427,679 B1
(45) Date of Patent: Aug. 6, 2002

(54) SLIM COOKER HOOD CASING

(75) Inventor: Tsih Chuan Chen, Chang-Hua Hsien (TW)

(73) Assignee: Lucky Seven Kitchen Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 09/954,119

(22) Filed: Sep. 11, 2001

(51) Int. Cl.[7] ..... F24C 15/20
(52) U.S. Cl. ..... 126/299 R; 126/299 D
(58) Field of Search ..... 126/299 R, 299 D, 126/21 R, 300, 301, 307 R; 55/DIG. 56

(56) References Cited

U.S. PATENT DOCUMENTS 1,465,652 A * 8/1923 Moore ..... 126/299 D
2,596,874 A * 5/1952 Sonntag ..... 126/299 D
2,862,436 A * 12/1958 Atwood ..... 126/299 D
5,927,268 A * 7/1999 Chiang et al. ..... 126/299 D

* cited by examiner

*Primary Examiner*—James C. Yeung
(74) *Attorney, Agent, or Firm*—Pro-Techtor International Services

(57) ABSTRACT

A slim cooker hood casing, comprising a casing and a frame. The casing has a front sheet, two lateral sheets, a top sheet and a back sheet. The frame is fastened to the lower edge of the casing and further comprises a front bar and two side bars. The front bar has a rear side with a vertical strip, which is connected with a connecting strip at the front edge of the front sheet. The two side bars have inner sides with downward bent vertical strips, which are connected with connecting strips at the lower edges of the two lateral sheets. Thereby the frame reinforces the casing, reducing vibrations of the casing during operation.

2 Claims, 8 Drawing Sheets

SLIM COOKER HOOD CASING

BACKGROUND OF THE INVENTION

1. Field of the Invention

The present invention relates to a slim cooker hood casing, particularly to a slim cooker hood casing having a reinforcement for greater strength and being easily mountable and dismountable.

2. Description of Related Art

A conventional cooker hood casing is formed of a single metal sheet and punched. Being made of a metal sheet, a casing is structurally weak. A lower plate is needed as a reinforcement, but strength thereof is insufficient. Thus, when the cooker hood is running, vibrations develop, resulting in a high level of noise.

Furthermore, today—s cooker hoods are usually integrated into kitchen furniture. Often an opening in a cupboard is prepared to accommodate a cooker hood, two sides of which are then fastened to the cupboard. The cooker hood has a front side of the same color as of the kitchen furniture to provide for a uniform look. Thus space is saved and a beautiful appearance is achieved.

However, when the cooker hood is installed, hanging elements have to be provided on a back side thereof close to a wall. Then hanging elements protrude from the cooker hood casing outward or upward. Since the cooker hood is combined with the cupboard, holes have to be dug into side walls thereof that contact the cooker hood, damaging the cupboard and making installation of the cooker hood awkward.

SUMMARY OF THE INVENTION

It is the main object of the present invention to provide a slim cooker hood casing of high structural strength for low noise during operation.

Another object of the present invention is to provide a slim cooker hood casing having openings for accommodating hanging elements, avoiding damaging of adjacent kitchen furniture during installation.

The present invention can be more fully understood by reference to the following description and accompanying drawings.

DETAILED DESCRIPTION OF THE PREFERRED EMBODIMENT

Figure 1:
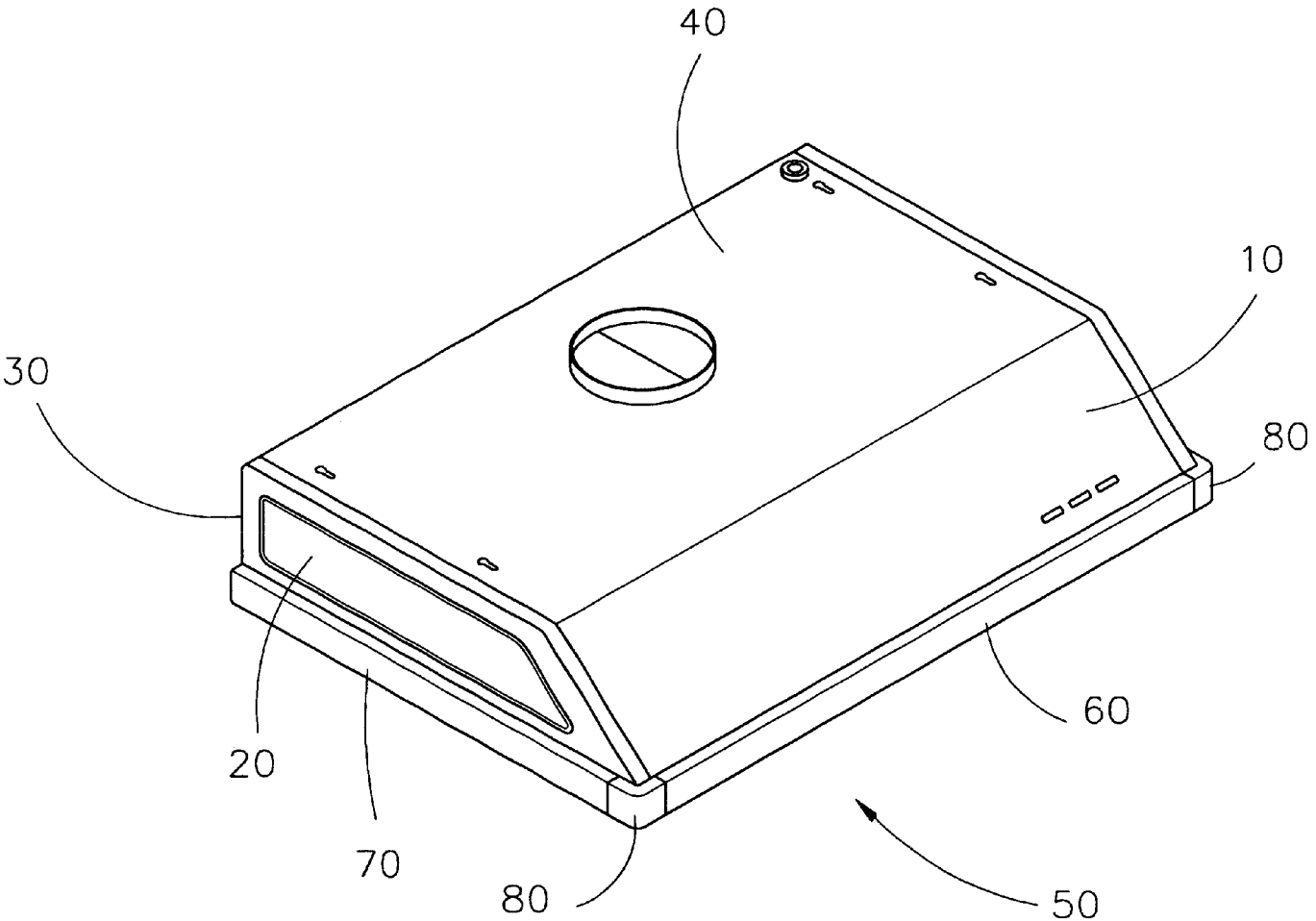
FIG. 1 is a perspective view of the slim cooker hood casing of the present invention.

As shown in FIG. 1, the slim cooker hood casing of the present invention mainly comprises: a front sheet 10; two lateral sheets 20; a back sheet 30; a top sheet 40; and a frame 50. The front sheet 10, the two lateral sheets 20, the back sheet 30 and the top sheet 40 form an upper half of a casing. The frame 50 runs along lower edges of the front sheet 10 and the two lateral sheets 20, forming a lower part of the casing and providing a reinforcement therefor.

Figure 2:
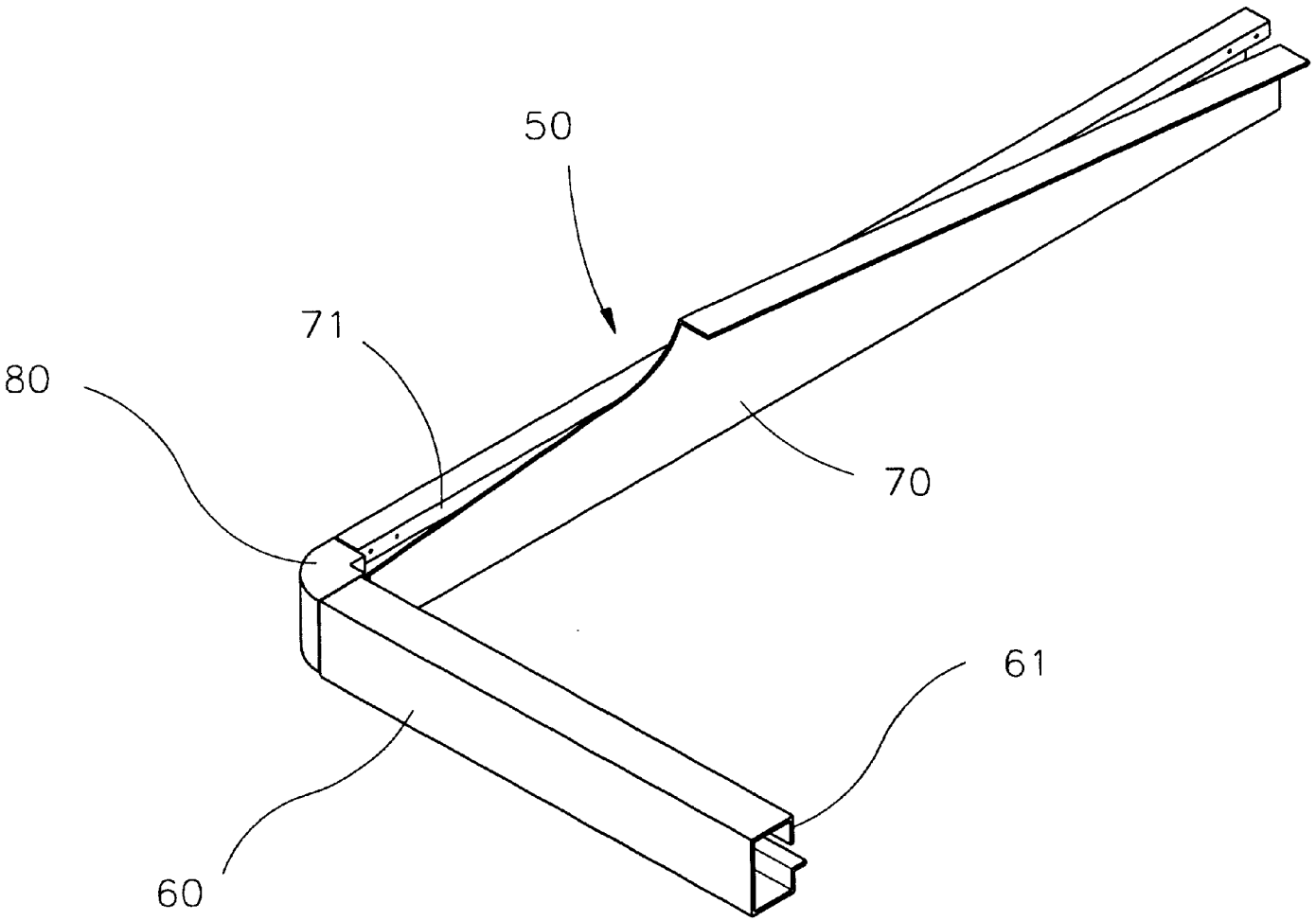
FIG. 2 is a partial perspective view of the frame of the present invention when assembled.
Figures 3A, 3B, 3C:
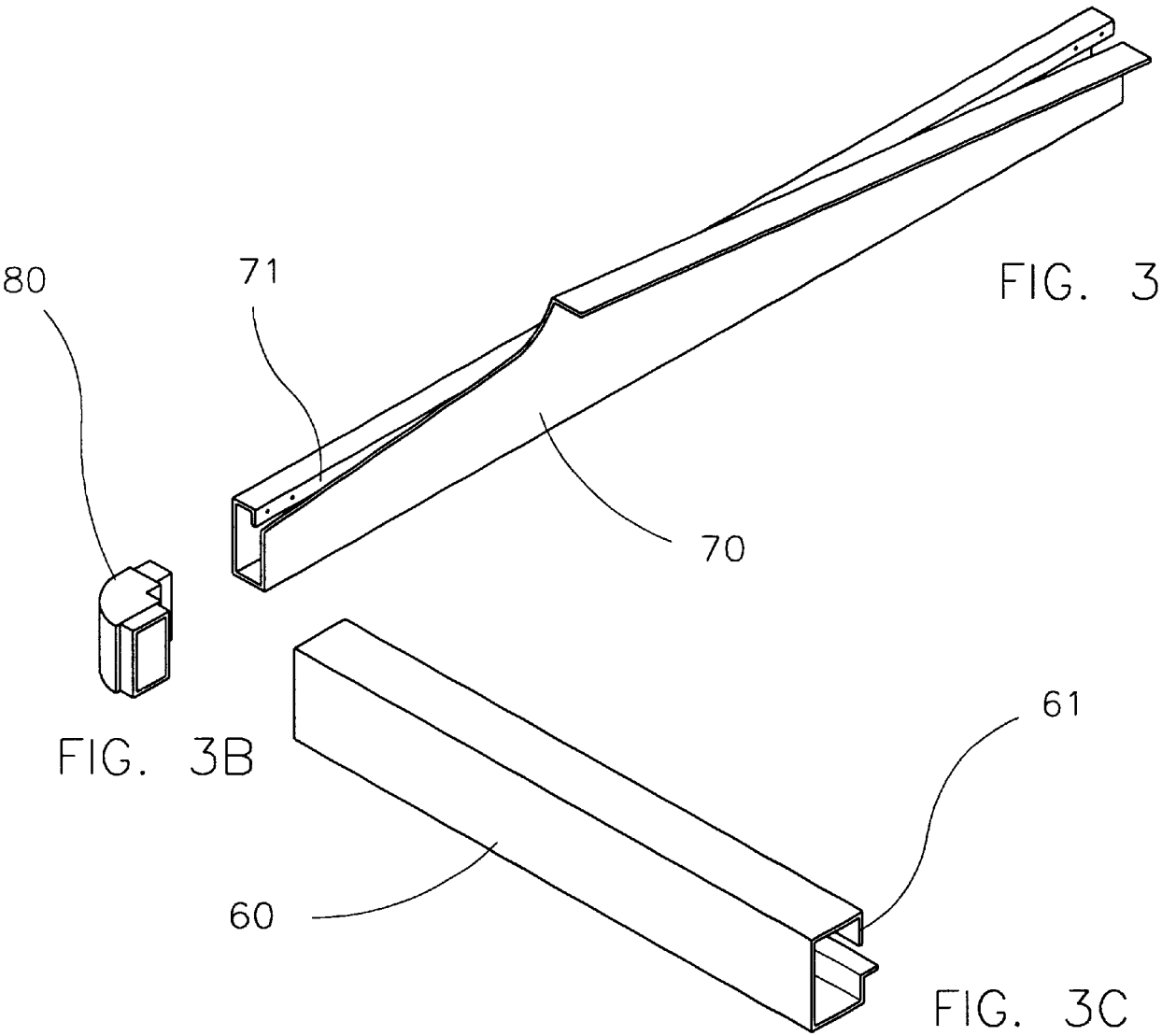
FIGS. 3A–3C are partial perspective views of structural parts of the frame of the present invention.
Figure 4:
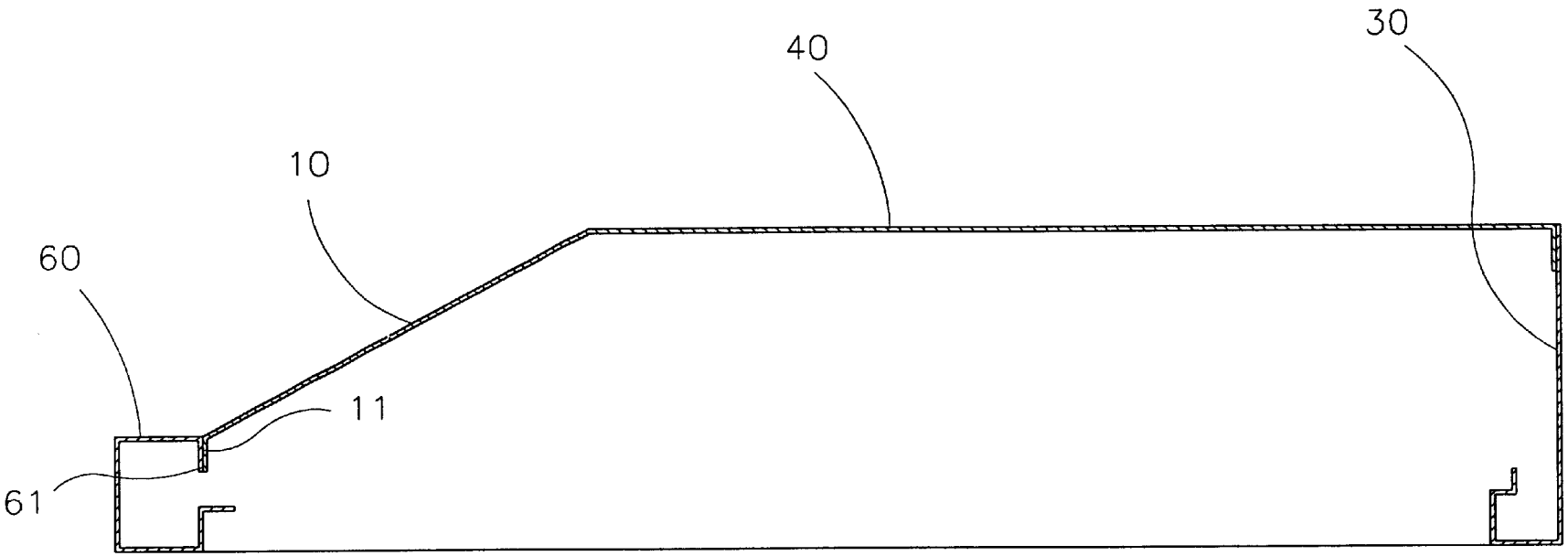
FIG. 4 is a sectional view of the front bar of the present invention, assembled with the front sheet.
Figure 5:
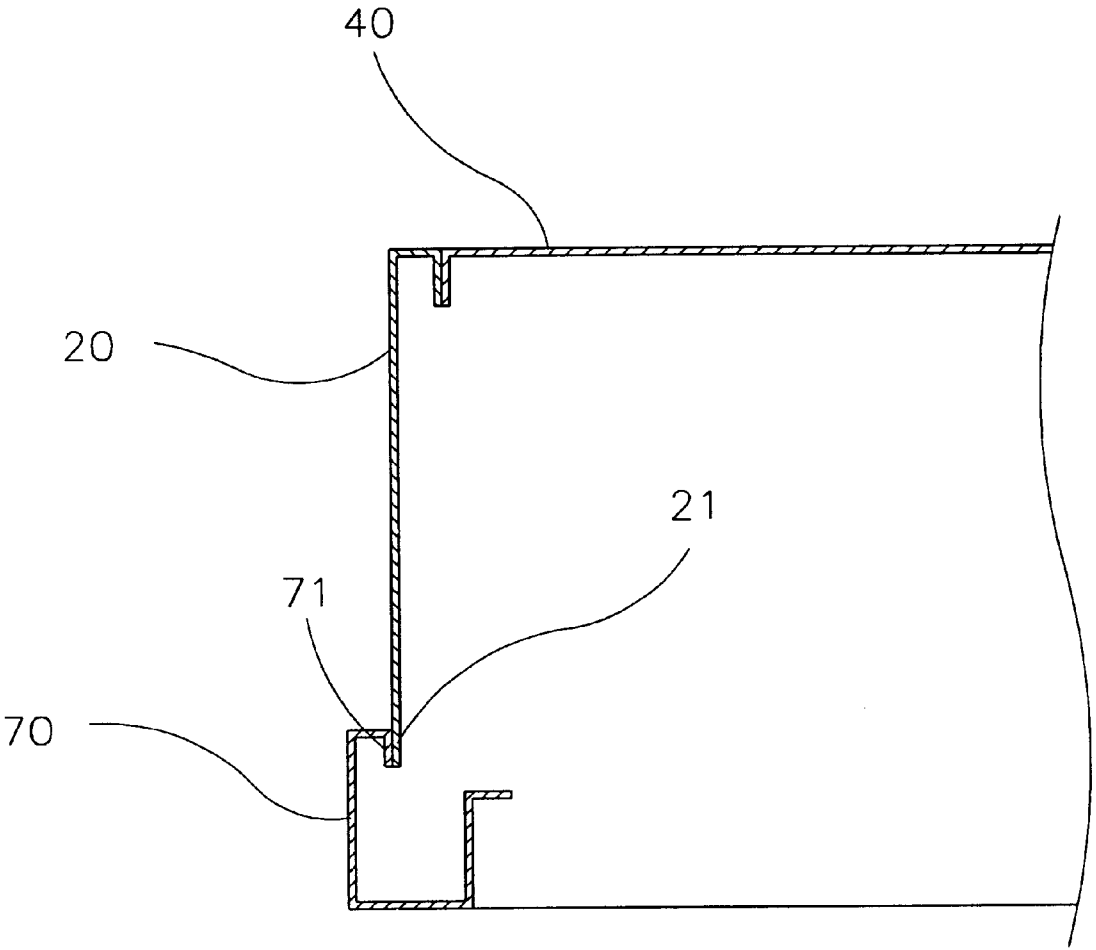
FIG. 5 is a sectional view of one of the side bars of the present invention, assembled with one of the lateral sheets.

Referring to FIG. 2, the frame 50 is made of bars of square cross-sections, comprising: a front bar 60; two side bars 70; and joints 80 for connecting the front bar 60 and the side bars 70. As shown in FIGS. 4 and 5, the front bar 60 has a length that is equal to the width of the casing at the lower edge thereof and is fastened to the front sheet 10 at the lower edge thereof. The two side bars 70 are fastened to the lateral sheets 20 at the lower edges thereof. The frame 50 has rear ends that are connected with the back sheet 30. As shown in FIGS. 3A, 3B, 3C, the front bar 60 and the two side bars 70 are hollow bodies with end openings. The joints 80 each are bent at an angle of 90 degrees, having ends that fit into the end openings of the front bar 60 and the two side bars 70, so that after assembly the front bar 60 and each of the two side bars 70 are mutually oriented at an angle of 90 degrees.

Referring to FIG. 3A, the two side bars 70 are metal plates which are punched and bent. Each of the two side bars 70 is bent at an upper edge of an outer side, continuing inward and being bent again, continuing downward as a vertical strip 71. As shown in FIG. 5, each of the two lateral sheets 20 has a contact strip 21 at the lower edge thereof, contacting the vertical strip 71 of one of the two side bars 70 by riveting or welding. As shown in FIG. 2, the front bar 60 is a punched metal plate, bent into a square bar, with a rear side thereof having a vertical strip 61. As shown in FIG. 4, the front sheet has a contact strip 11 at a front edge thereof, contacting the vertical strip 61 by riveting or welding. Due to the connections of the contact strips 11, 21 with the vertical strips 61, 71, the front bar 60 and the two side bars 70 are fastened to the front sheet 10 and the lower edges two lateral sheets 20, respectively.

Figure 4A:
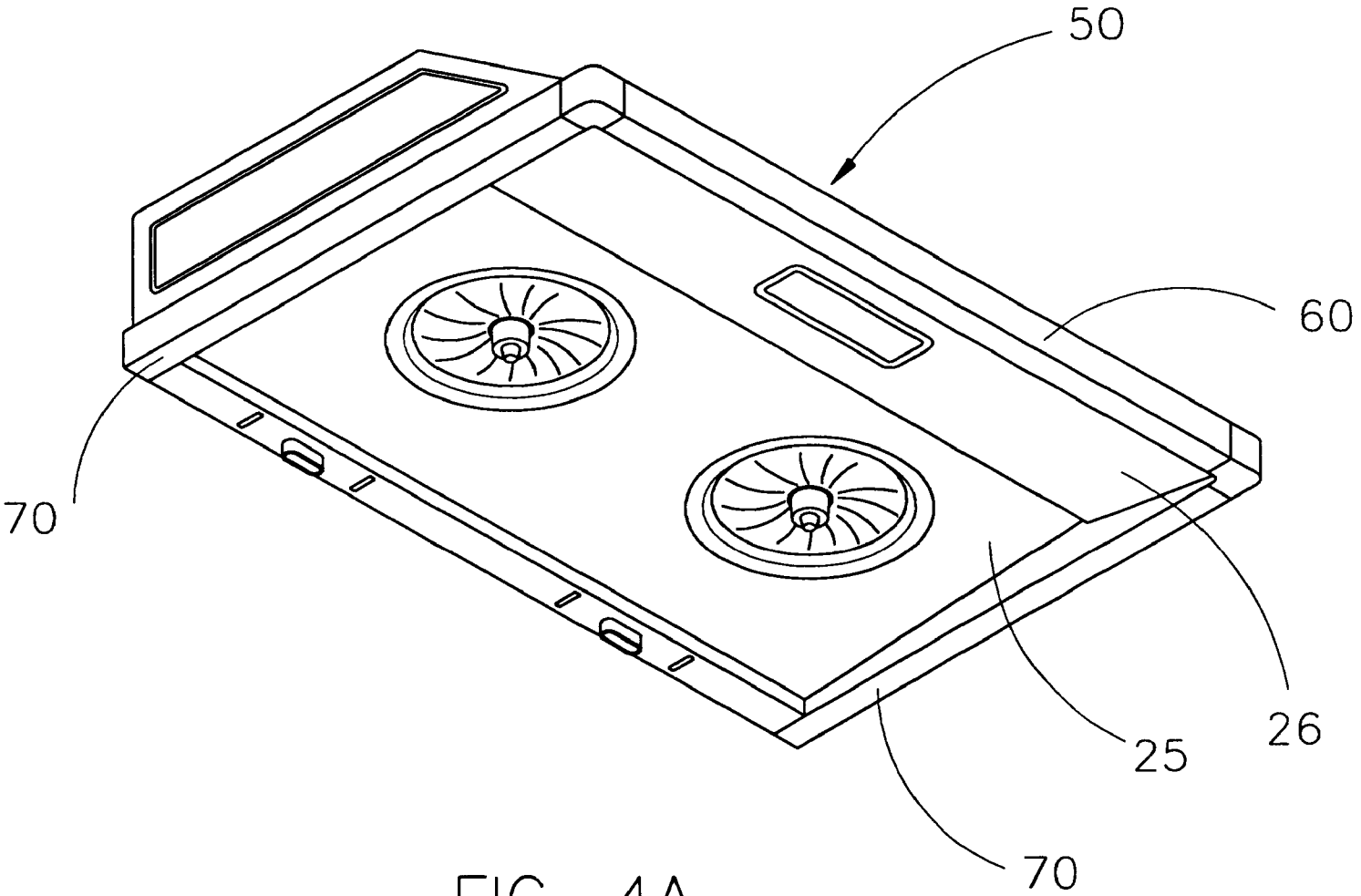
FIG. 4A is a perspective view of the front and side bars of the present invention, with the bottom sheet inserted.

Since the frame 50 has a square cross-section, stability thereof is high, reinforcing the casing at the lower edge thereof and allowing easily to mount and dismount any device at a lower side for an improved cooker hood system. As shown in FIG. 4A, due to the reinforcement provided by the frame 50, various designs at the lower sides are possible: A forward bottom plate 25 is inserted between the two side bars 70, having two openings for a pair of ventilators. A rearward bottom plate 26, placed behind the forward bottom plate 25. The forward and rearward bottom plates 25, 26have edges that are tightly connected with the front bar 60 and the side bars 70. The design of the frame 50 ensures excellent stability of the casing. The casing is not easily bent, so during operation of the cooker hood, vibrations are reduced, resulting in reduced noise.

Figure 6:
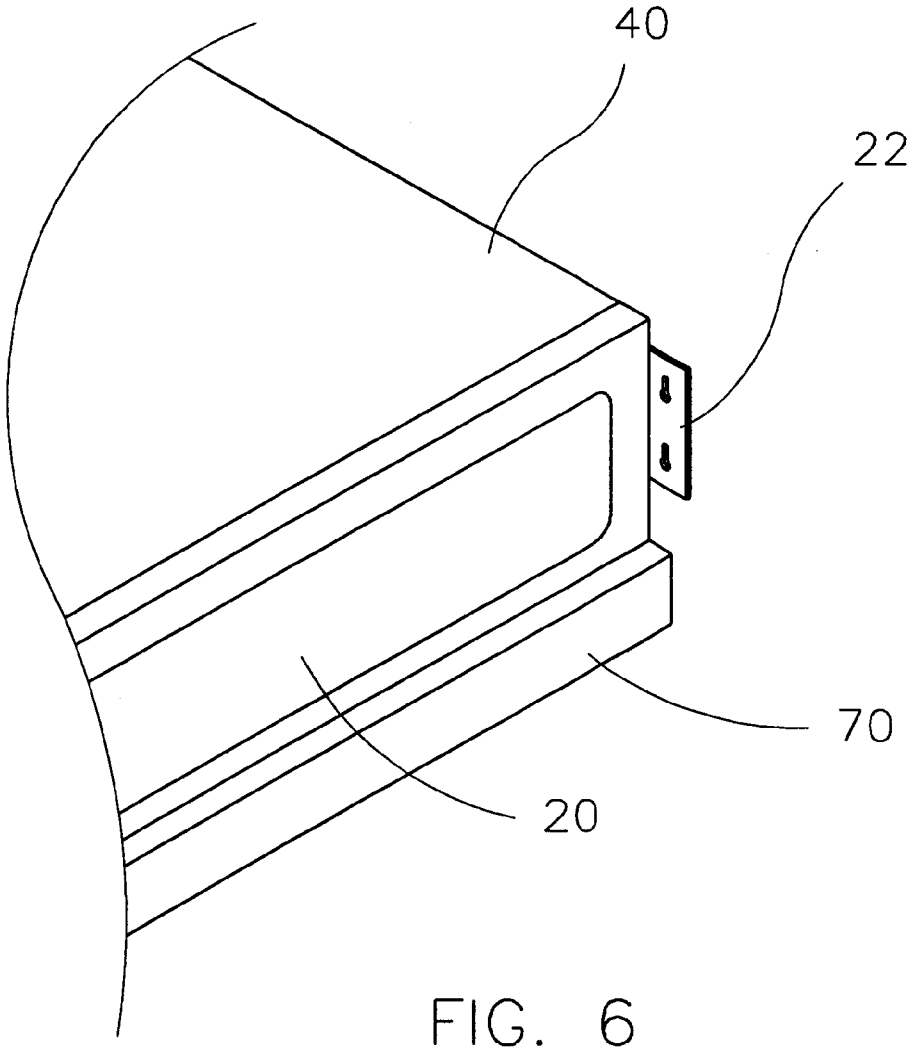
FIG. 6 is an enlarged perspective view of one of the rear corners of the casing of the present invention.
Figure 7:
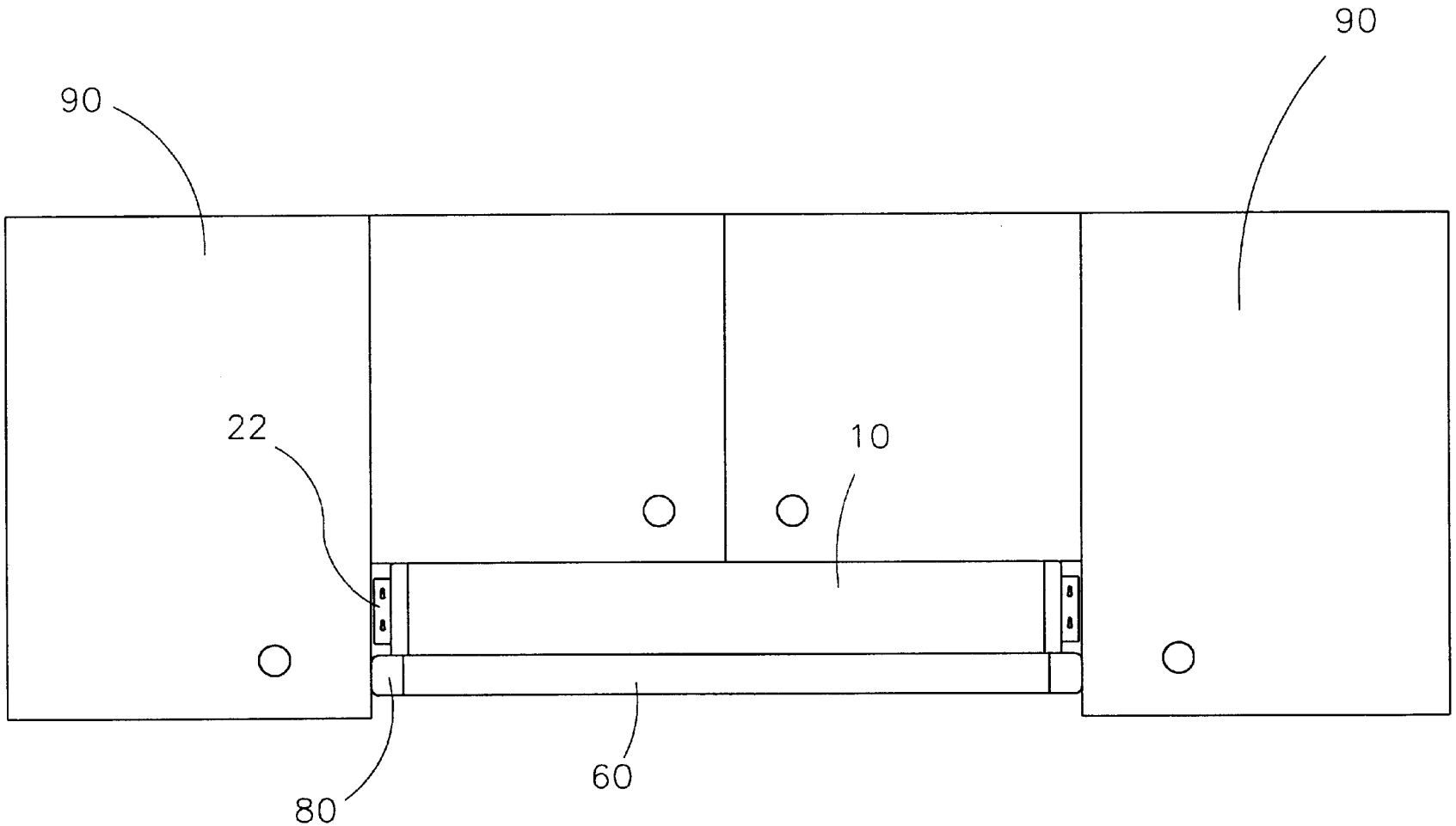
FIG. 7 is a schematic illustration of the slim cooker hood casing of the present invention in conjunction with a cupboard.

Referring again to FIG. 5, the two side bars 70 extend beyond the two lateral sheets 20. Thus, as shown in FIG. 6, the two side bars 70 and the two lateral sheets 20 form steps on both sides. When, as shown in FIG. 7, the cooker hood is installed in an opening of a cupboard 90, only the two side bars 70 contact the cupboard 90, while gaps remain between the two lateral sheets 20 and the cupboard 90. Therefore, hanging elements 22, mounted on the rear side of the casing and protruding on both lateral sides thereof, as shown in FIG. 6, are accommodated by the gaps. Therefore, installing the cooker hood will not damage the cupboard 90.

While the invention has been described with reference to a preferred embodiment thereof, it is to be understood that modifications or variations may be easily made without departing from the spirit of this invention which is defined by the appended claims.

What is claimed is:

1. A slim cooker hood casing, comprising:

a front sheet with a front edge, two lateral sheets with lower edges, a top sheet, a back sheet, a frame fastened to a lower edge of said casing, said frame comprising:

a front bar having a rear side, said front bar is fastened to said front sheet by means of a vertical strip which is connected to a connecting strip at said front edge of said front sheet, two side bars having inner sides with downward bent vertical strips, said vertical strips are connected to connecting strips at said lower edges of said two lateral sheets, said vertical strips thereby fastening said two side bars to said two lateral sheets; wherein said frame reinforces said casing so as to reduce vibration of said casing during operation, and wherein said frame further comprises joints, said joints connecting said front bar at lateral ends thereof to said two side bars at front ends thereof, so that said frame has a rectangular shape.

2. The slim cooker hood casing according to claim 1, wherein: said two side bars protrude beyond said two lateral sheets.

* * * * *